US006041245A

United States Patent [19]

Mansour

[11] Patent Number: 6,041,245

[45] **Date of Patent: *Mar. 21, 2000**

[54] HIGH POWER SUPERCONDUCTIVE CIRCUITS AND METHOD OF CONSTRUCTION THEREOF

[75] Inventor: Raafat R. Mansour, Waterloo, Canada

[73] Assignee: Com Dev Ltd., Cambridge, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 08/577,156

[22] Filed: Dec. 22, 1995

[30] Foreign Application Priority Data

Dec. 28, 1994 [GB] United Kingdom ..... 9426294

[51] Int. Cl.[7] ..... H01P 3/08; H01B 12/02

[52] U.S. Cl. ..... 505/210; 505/700; 505/701; 505/866; 333/99.005; 333/238; 333/204

[58] Field of Search ..... 333/995, 238, 333/246, 204; 505/210, 700, 701, 866, 704

[56] References Cited

U.S. PATENT DOCUMENTS

| | | | |
|---|---|---|---|
| 3,681,713 | 8/1972 | Degenkolb et al. | 333/219 |
| 5,215,959 | 6/1993 | Van Duzer | 333/995 X |
| 5,219,827 | 6/1993 | Higaki | 333/995 X |
| 5,324,713 | 6/1994 | Shen | 333/995 X |

FOREIGN PATENT DOCUMENTS

| | | | |
|---|---|---|---|
| 263745 | 10/1988 | Japan | 505/704 |
| 273402 | 11/1989 | Japan | 333/238 |
| 17701 | 1/1990 | Japan | 333/204 |
| 5-029809 | 2/1993 | Japan | 333/238 |
| 6097708 | 4/1994 | Japan | 333/238 |

*Primary Examiner*—Benny T. Lee
*Attorney, Agent, or Firm*—Daryl W. Schnurr

[57] ABSTRACT

A high power high temperature superconductive circuit for use in various microwave devices including filters, dielectric resonator filters, multiplexers, transmission lines, delay lines, hybrids and beam-forming networks has thin gold films deposited either on a substrate or on top of the high temperature superconductive film. Alternatively, other metal films can be used or a plurality of dielectric films can be used or a dielectric constant gradient substrate can be used. The use of these materials in a part or parts of a microwave circuit reduces the current density in those parts compared to the level of current density if only high temperature superconductive film is used. This increases the power handling capability of the circuit.

18 Claims, 17 Drawing Sheets

FIGURE 8

HIGH POWER SUPERCONDUCTIVE CIRCUITS AND METHOD OF CONSTRUCTION THEREOF

BACKGROUND OF THE INVENTION

1. Field of the Invention

This invention relates to high power high temperature superconductive microwave circuits for various microwave devices and to a method of enhancing the power capability of such circuits.

2. Description of the Prior Art

High temperature superconductive (HTS) microwave devices enhance system performance with respect to noise figure, loss, mass and size compared to non-HTS devices. It is known to use HTS technology to design microwave components with superior performance (See Z. Y. Shen, "High Temperature Superconducting Microwave Circuits", Artech House Inc., Norwood, Mass., 1994; R. R. Mansour, "Design of Superconductive Multiplexers Using Single-Mode and Dual-Mode Filters", IEEE Trans. Microwave Theory Tech., Vol. MTT-42, pp. 1411–1418, July, 1994; Talisa, et al., "Low and High Temperature Superconductive Microwave Filters", IEEE Trans. Microwave Theory Tech., Vol. MTT-39, pp. 1448–1453, September, 1991; and Mathaei, et al., "High Temperature Superconducting Bandpass Filter for Deep Space Network", IEEE, MTT-S Symp. Digest, pp. 1273–1276, 1993). Typical microwave systems include high power as well as low power components but previous devices have concentrated on low power applications. Significant performance and economic benefits can be derived from the availability of both low power and high power HTS components.

For high power applications, the behavior of HTS thin films is quite different from that for low power applications. For example, surface resistance degradation and non-linearity have been observed in HTS microwave films operating at modest microwave power levels (See Fathy, et al., "Critical Design Issues in Implementing a YBCO Superconductor X-Band Narrow Bandpass Filter Operating at 77 K", IEEE, MTT-S Symp. Digest, pp. 1329–1332, 1991). The degradation and superconductive performances caused by the increased current density in the films as the power level is increased. When the current density reaches a maximum level, the power handling capability is limited to the power input at that level. The ability of an HTS microwave device, for example, an HTS filter, to handle high power levels is not only governed by the quality of the HTS materials but also by the filter geometry and its electrical characteristics. As better HTS materials are developed, the power handling capabilities of microwave components will increase.

SUMMARY OF THE INVENTION

It is an object of the present invention to provide novel configurations for HTS microwave components that are capable of handling high power.

A high temperature superconductive circuit for use with microwave devices has high power handling capability. The circuit has a substrate and a high temperature superconductive film on the substrate. There are means to reduce current density in some of the high temperature superconductive film on top of part of the superconductive film. The means to reduce current density extends over part of the circuit leaving at least a substantial portion of the superconductive film exposed. The circuit has an input and output. Superconductive film and the means to reduce current density are configured to be in direct contact so that current can flow through the circuit between the input and output when a signal is applied to the input.

A high temperature superconductive circuit for use with microwave devices has high power handling capability. The circuit has high temperature superconductive film on a substrate. Part of the circuit has means to reduce current density in some of the high temperature superconductive film below a current density that would otherwise exist in operation of the device when the part is comprised of high temperature superconductive film without means to reduce current density. The part and the high temperature superconductive film at least partially overlap and the circuit has an input and output. The part and the high temperature superconductive film are configured to be in direct contact so that current can flow through the circuit between the input and output when a signal is applied to the input.

A method of enhancing the power capability of a high temperature superconductive circuit for use with microwave devices, the method comprising depositing a high temperature superconductive film on a substrate to form at least a portion of a microwave circuit, depositing means to reduce current density on specific areas of the high temperature superconductive film so that the means to reduce current density is in direct contact with the high temperature superconductive film to allow current to flow through the circuit between an input and an output when a signal is applied to the input, depositing the means to reduce current density in the specific areas of the circuit where the current density would otherwise be significantly higher than a remainder of the circuit where means to reduce current density has not been deposited.

A method of enhancing the power capability of a high temperature superconductive circuit for use with microwave devices, the method comprising depositing a high temperature superconductive film on a substrate to form at least a portion of a microwave circuit, depositing a plurality of dielectric films of different dielectric constants on top of at least some of the high temperature superconductive film to form means to reduce the current density in some of the high temperature superconductive film, the means to reduce the current density and the high temperature superconductive film being directly in contact so that current can flow through the circuit between an input and an output when a signal is applied to said input.

A method of enhancing the power capability of a high temperature superconductive circuit for use with microwave devices, the method comprising depositing a high temperature superconductive film on a substrate to form at least a portion of a microwave circuit, depositing a constant gradient substrate on top of at least some of the high temperature superconductive film to form means to reduce the current density in some of the superconductive film, said means to reduce the current density and the high temperature superconductive film being directly in contact so that current can flow through the circuit between an input and an output when a signal is applied to the input.

BRIEF DESCRIPTION OF THE DRAWINGS

The foregoing and other objects and advantages of the invention will become apparent from the following description. In the description, reference is made to the accompanying drawings which form a part hereof and which there is shown by way of illustration a preferred embodiment of the invention.

In the drawings.

DESCRIPTION OF A PREFERRED EMBODIMENT

Figure 1:
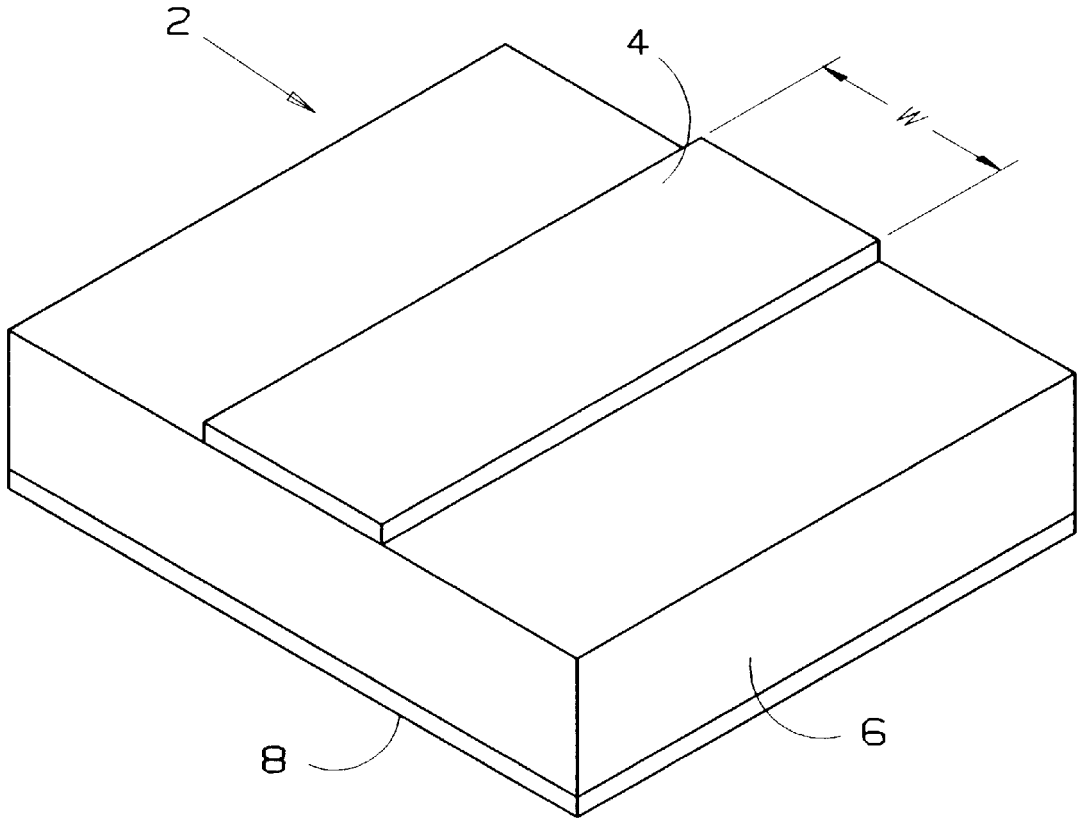
FIGURE 1 PRIOR ART
FIG. 1 is a perspective view of a prior art high temperature superconductive microstrip line.

In FIG. 1, there is shown a high temperature superconductive (henceforth referred to as HTS) microstrip line 2 having an HTS film 4 with a width W located on a substrate 6. Beneath the substrate 6 is a ground plane 8. The ground plane can be made out of HTS film or a metal. Preferably, HTS film is made from ceramic material e.g. ceramic oxide superconductor.

Figure 2:
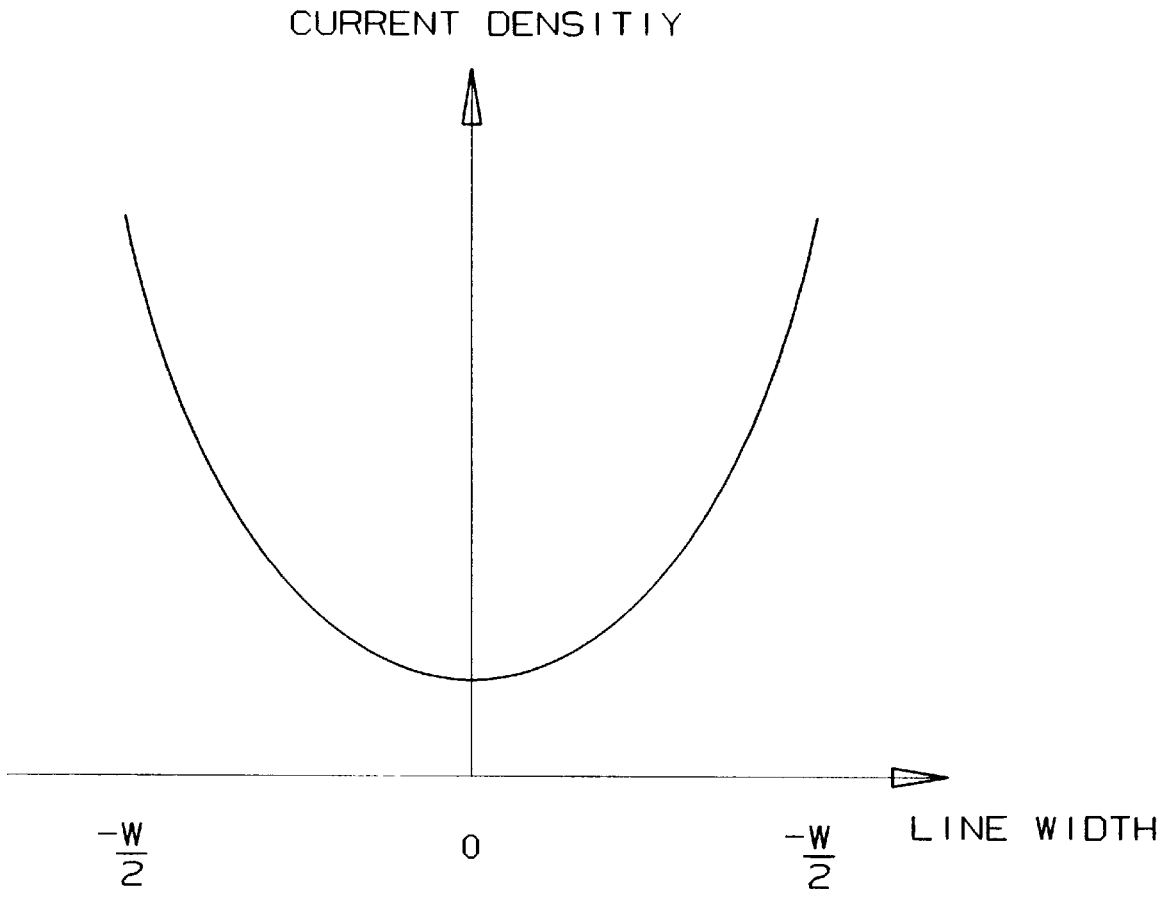
FIGURE 2 PRIOR ART
FIG. 2 is a graph showing the current distribution on the microstrip line of FIG. 1.

In FIG. 2, there is shown a graph of a typical distribution of current density over the line width W of the HTS film 4 of the microstrip line 2 in FIG. 1. It can be seen that the current density is lowest at a center (0) of the HTS film 4 and highest at the outer edges (−W/2, +W/2. In high power applications, the current density at the edges may exceed the critical current density of the superconductive material. If the current density at the edges does exceed the critical current density of the superconductive material, the edges of the film will lose their superconductive characteristics.

Figure 3:
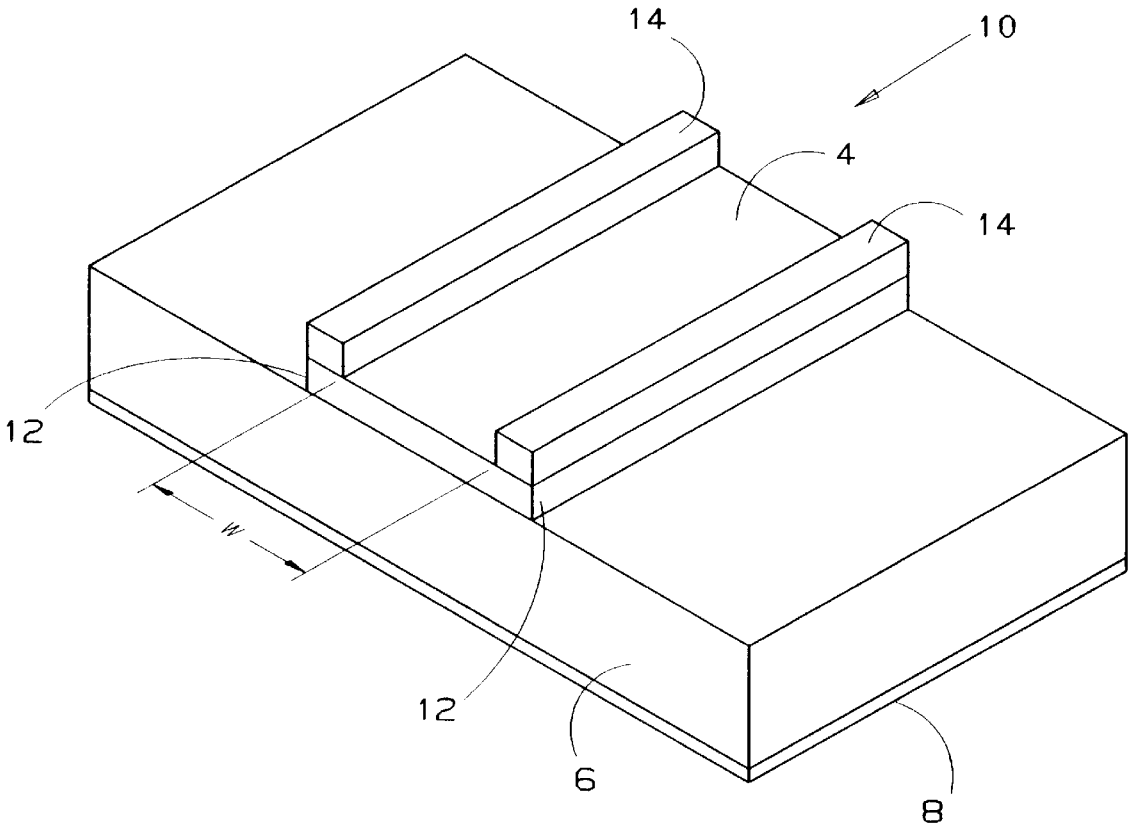
FIG. 3 is a perspective view of a high power high temperature superconductive microstrip line in accordance with the present invention.

In FIG. 3, the same reference numerals are used for those components that are the same or similar to that shown in FIG. 1. A microstrip line 10 has an HTS film 4 with a width W. The film 4 is located on a substrate 6 with a ground plane 8 being located beneath the substrate. The HTS film has two outer edges 12. On top of each outer edge, there is deposited a thin film 14 of gold or any other highly conductive metal (for example, silver and copper). Gold films 14 extend the power handling capability of the microstrip line 10 by reducing the current density in those areas where the gold films are located by providing paths for the current even if the edges 12 of the film 4 are no longer in the superconductive state.

Figure 4:
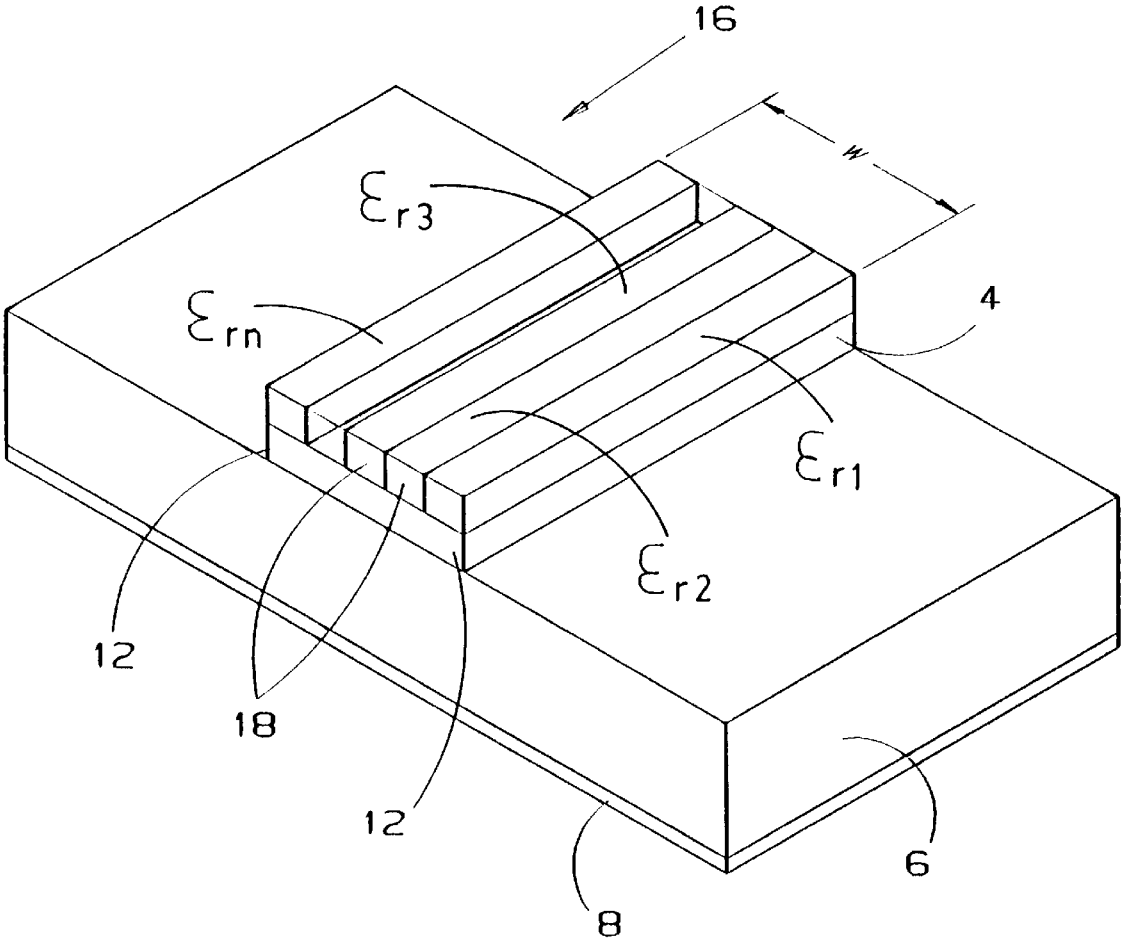
FIG. 4 is a perspective view of a further embodiment of a high power high temperature superconductive microstrip line.

In FIG. 4, the same reference numerals are used for those components that are the same or similar to those components of FIG. 3. It can be seen that a microstrip line 16 has a plurality of dielectric films 18 deposited on top of the HTS film 4. The dielectric films 18 have different dielectric constants $E_{r1}$, $Er_2$, $E_{r3}$ . . . $E_{rn}$ to reduce the current density that would otherwise exist in the HTS film 4 if the dielectric films 18 were not present. The film 4 has outer edges 12.

Figure 5:
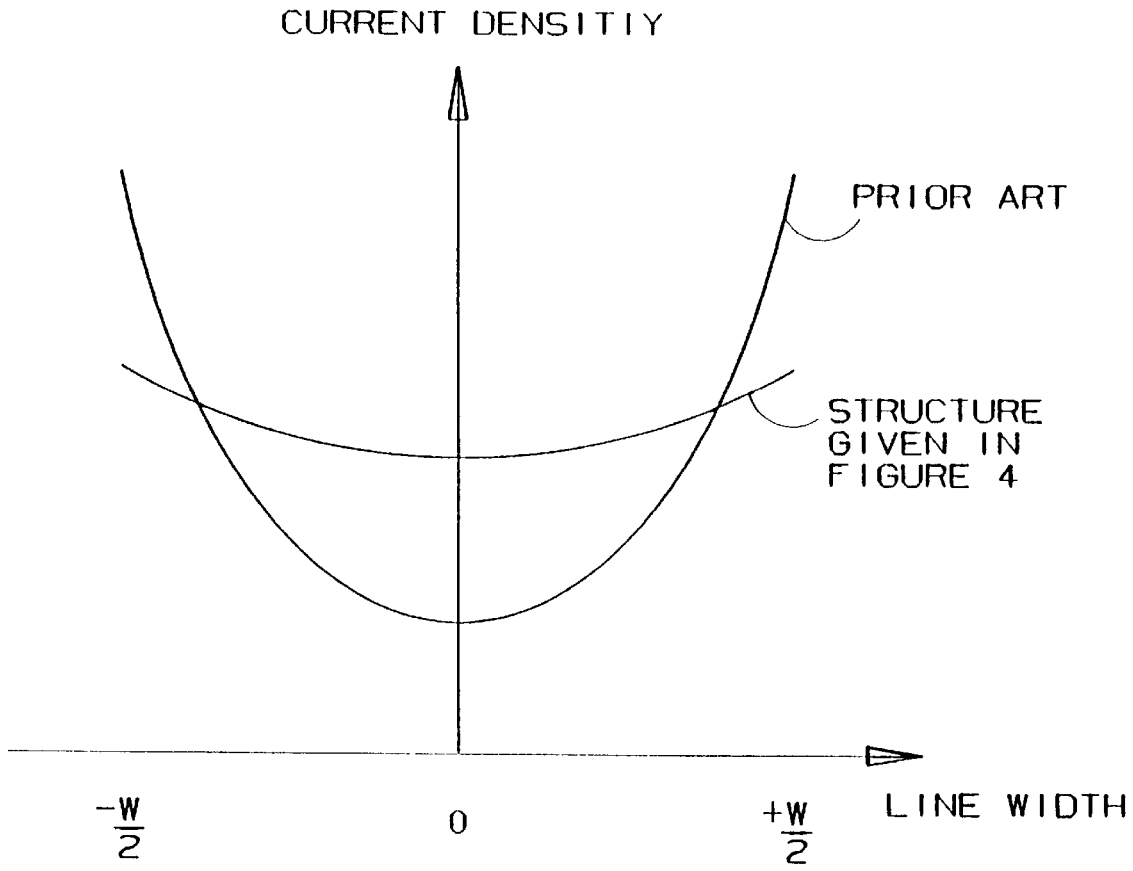
FIG. 5 is a graph comparing the current distribution of the prior art microstrip line of FIG. 1 and the high power microstrip line of FIG. 4.

In FIG. 5, there is shown a graph of the current density distribution across the HTS film 4 for the prior art microstrip line 2 shown in FIG. 1 and the microstrip line 16 shown in FIG. 4. On the linewidth, 0 represents a longitudinal center of the HTS film, −W represents one side of said HTS film and +W represents an opposite side of said HTS film. It can be seen that the structure shown in FIG. 4 has a current density that is much more even distributed over the entire width of the HTS film 4 than the current density over the HTS film 4 in the prior art device 2. In other words, the current density at the outer edges of the HTS film 4 in the device 16 is reduced over that in the prior art device 2. This reduction of the current density at the outer edges 12 reduced the current flowing at said edges 12, thereby enhancing the power handling capability of the device 16.

Figure 6:
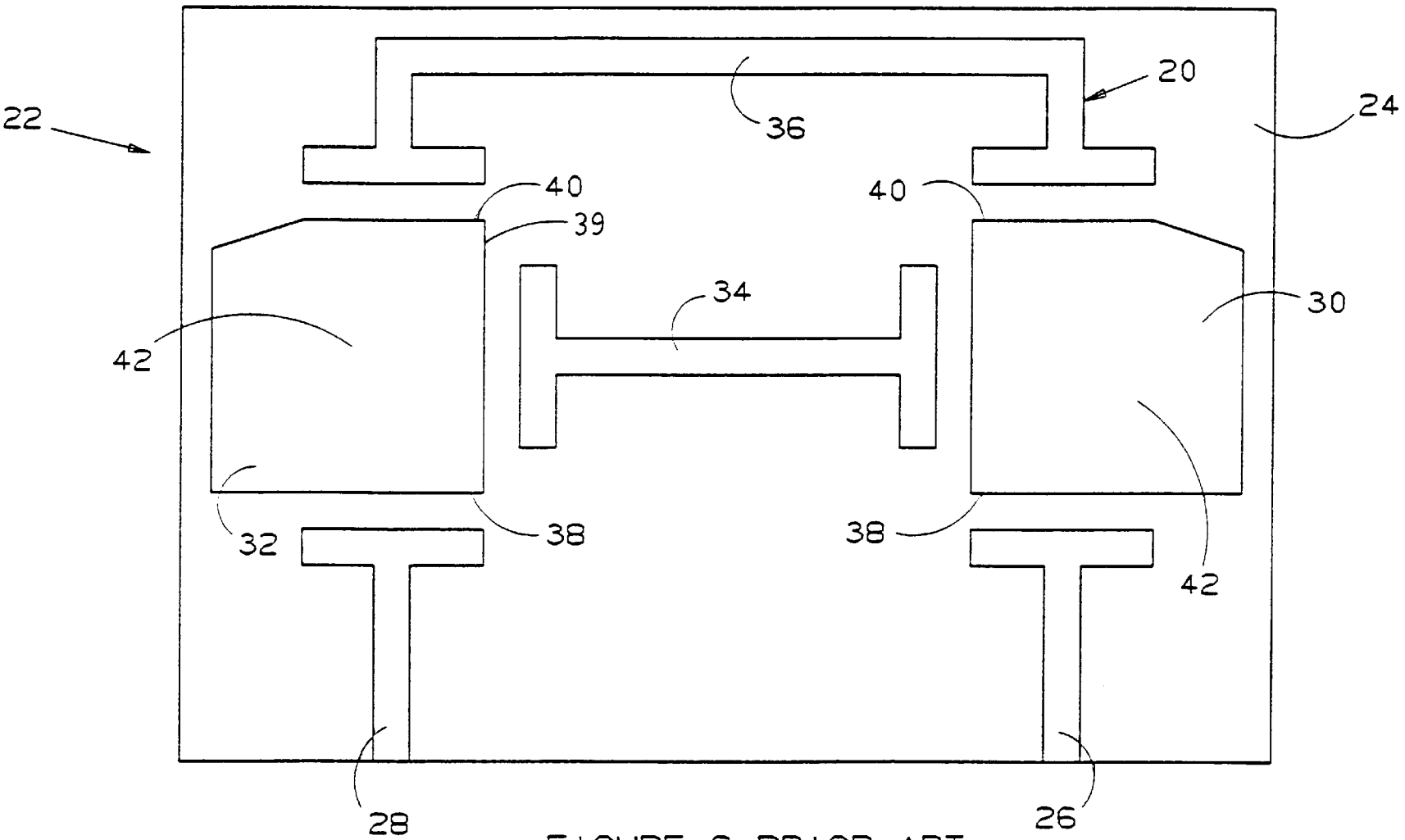
FIGURE 6 PRIOR ART
FIG. 6 is a schematic top view of a prior art dual mode high temperature superconductive filter.
Figure 7:
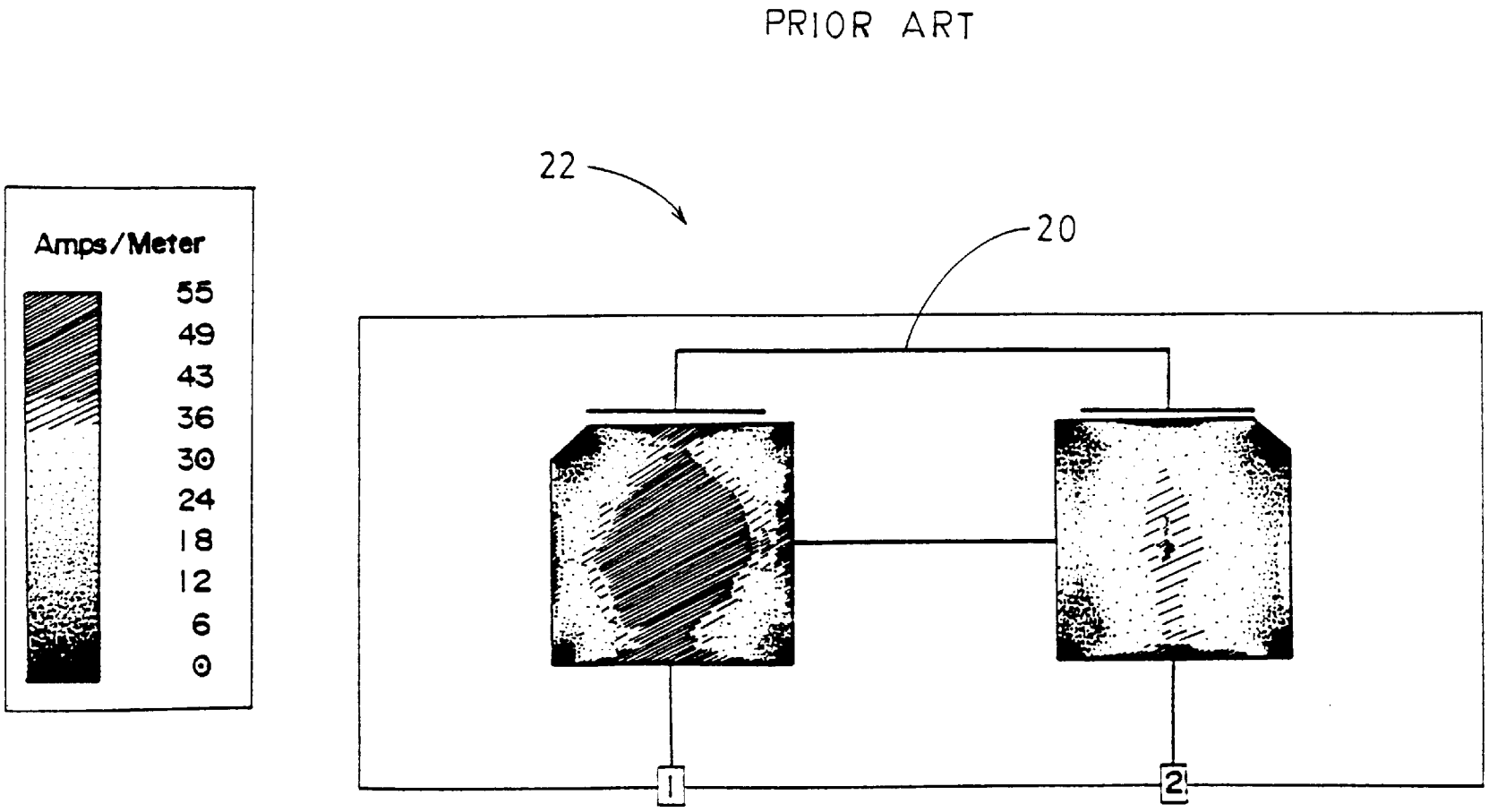
FIG. 7 is a schematic top view with a legend showing the current distribution on the prior art filter of FIG. 6.

In FIG. 6, there is shown a top view of a circuit 20 for a prior art dual mode filter 22. The circuit 20 is made from HTS films that are deposited on a substrate 24. The filter 22 has an input coupling 26 and an output coupling 28 with two patches or resonators 30, 32. Coupling between the patches is provided by coupling elements 34, 36. The substrate 24 can be made from any dielectric material. Resonators 30, 32 each have outer edges 38, 39, 40 as well as a center area 42. FIG. 7 shows the current distribution in the prior art circuit 20 of the filter 22. It can be seen that the coupling element 34 and the input and output couplings 26, 28 are areas of relatively high current density. Further, it can be seen that outer edges 38, 40 of each of the resonators 30, 32 adjacent to the input coupling 26 or output coupling 28 and the coupling element 36 are also areas of relatively high current density. Still further, it can be seen that a center area 42 of each of the resonators 30, 32 is also an area of relatively high current density.

Figure 8:
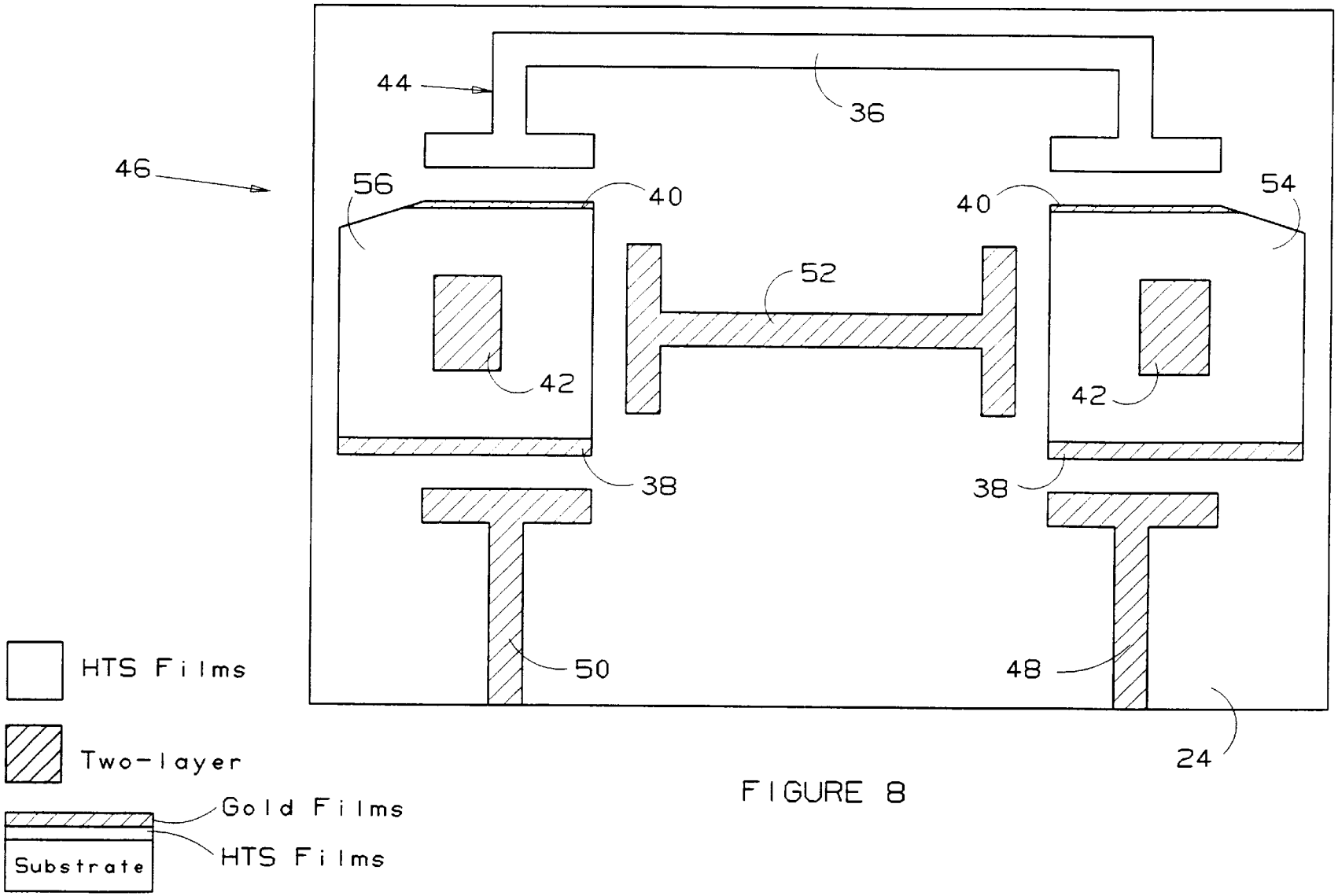
FIG. 8 is a top schematic view of a high power high temperature superconductive filter where part of a circuit of the filter is made from gold films.

In FIG. 8, there is shown a schematic top view of a circuit 44 of a filter 46 that is virtually identical to the filter 22 shown in FIG. 6 except that the cross-hatched areas of the filter 46 have a thin film of gold that has been deposited on top of parts of the HTS film of the circuit 20 of the filter 22 as seen in FIG. 6. More specifically, the gold film is deposited on input and output couplings 48, 50 on coupling element 52, on the outer edges 38, 40 and in the central area 42 of the resonators 54, 56. The purpose of the gold film is to reduce the current density in those areas compared to the current density that would occur in those same areas of the prior art filter 22, thereby increasing the power handling capability of the filter 46 relative to the prior art filter 22. The same reference numerals have been used for those components of the filter 46 that are identical to the filter 22.

Figure 9:
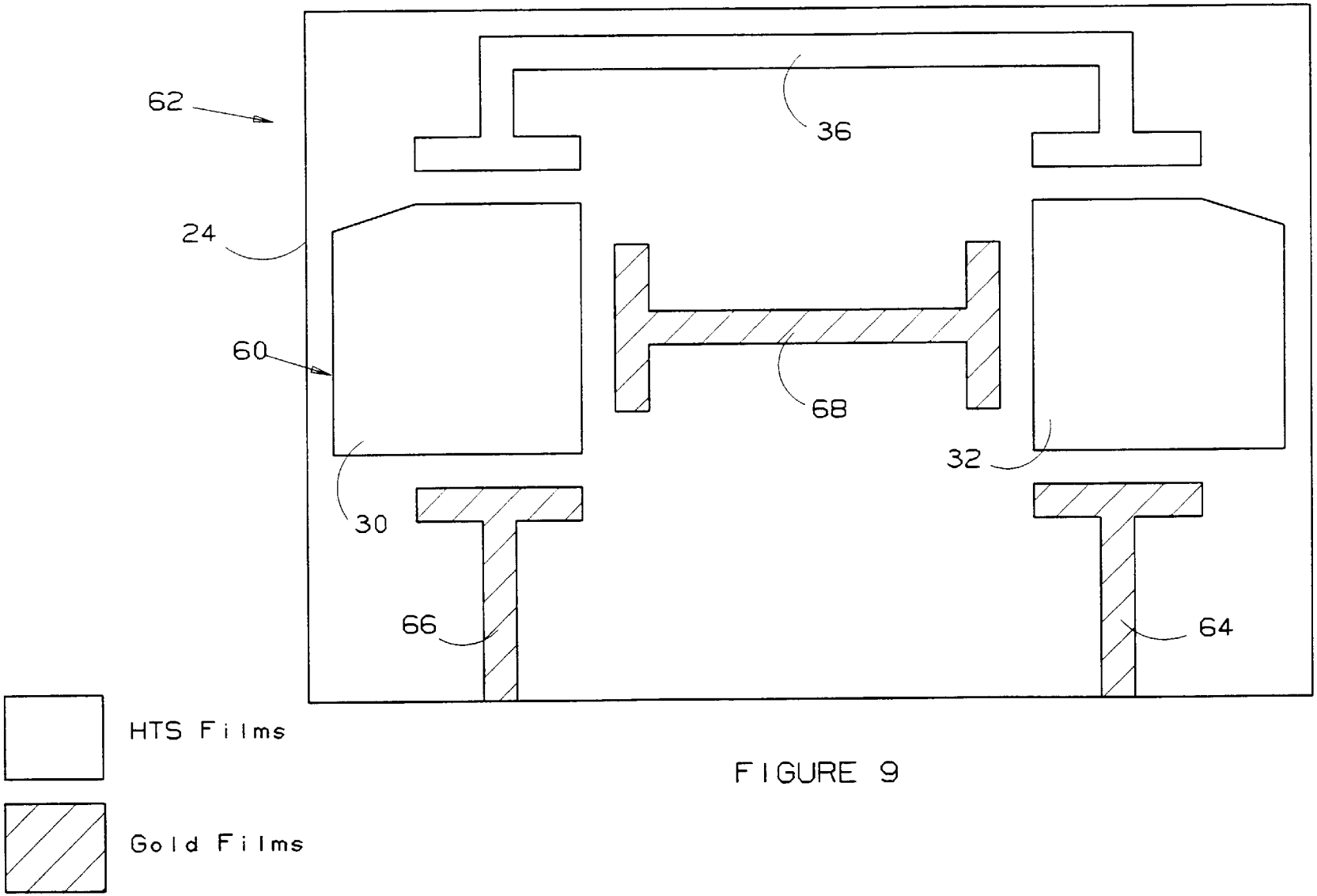
FIG. 9 is a schematic top view of a filter having gold films deposited on a substrate on part of a circuit.

In FIG. 9, there is shown a further embodiment of the invention in which a schematic top view of a circuit 60 of a filter 62 has gold films deposited on the substrate 24 in certain areas in place of the HTS films of the prior art filter 22 shown in FIG. 6. The same reference numerals are used for those components that are the same as those shown for the filter 22 of FIG. 6. The areas where the gold film has been deposited directly on the substrate 24 are shown with wide cross-hatching. These areas are input coupling 64, output coupling 66 and coupling element 68 extending between the resonators 30, 32. The use of the gold films for the components 64, 66, 68 reduces the current density in those components relative to the current density in the corresponding components in the prior art filter 22 at the same power level and thereby enhance the power handling capability of the filter 62 relative to the prior art filter 22. Since the resonators 30, 32 of the filter 62 are made from HTS film, the use of gold films for the components 64, 66, 68 causes only a minor degradation in the filter insertion loss performance vis-a-vis the prior art filter 22. In a further variation of the invention (not shown), the components 64, 66, 68 could have an HTS film deposited directly onto the substrate 24 with a gold film deposited on top of the HTS film for these three components only.

Figure 10:
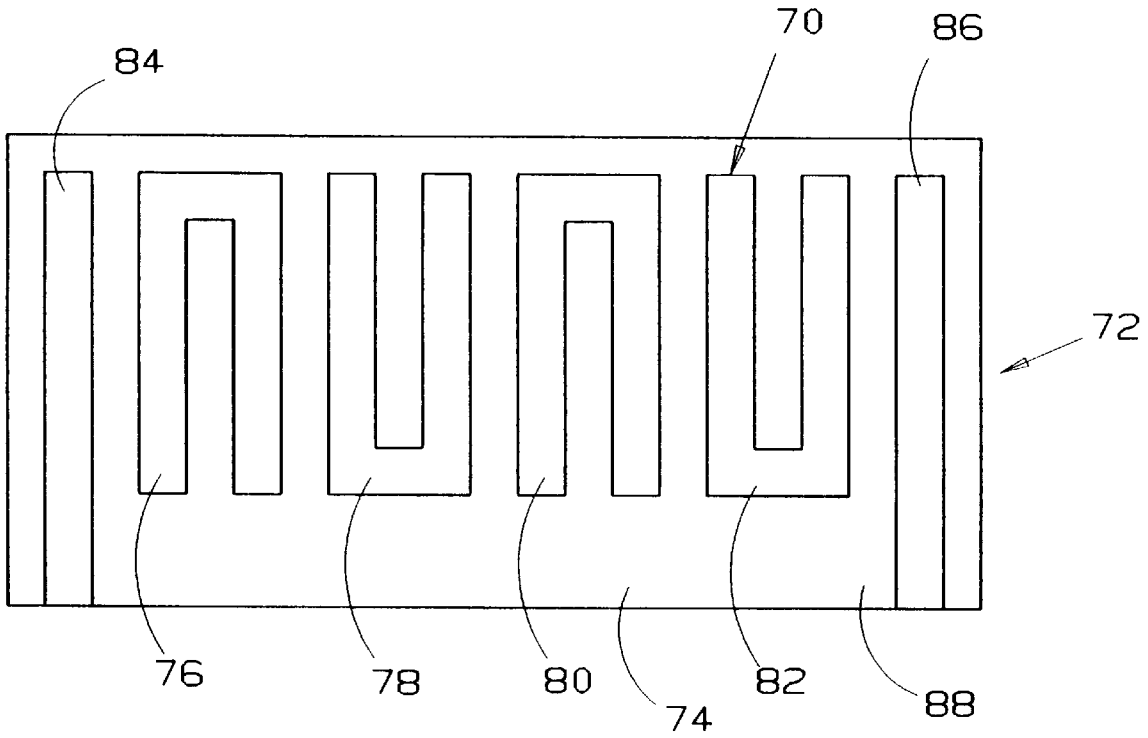
FIGURE 10 PRIOR ART
FIG. 10 is a top view of a circuit for a prior art hairpin high temperature superconductive filter.
Figure 11:
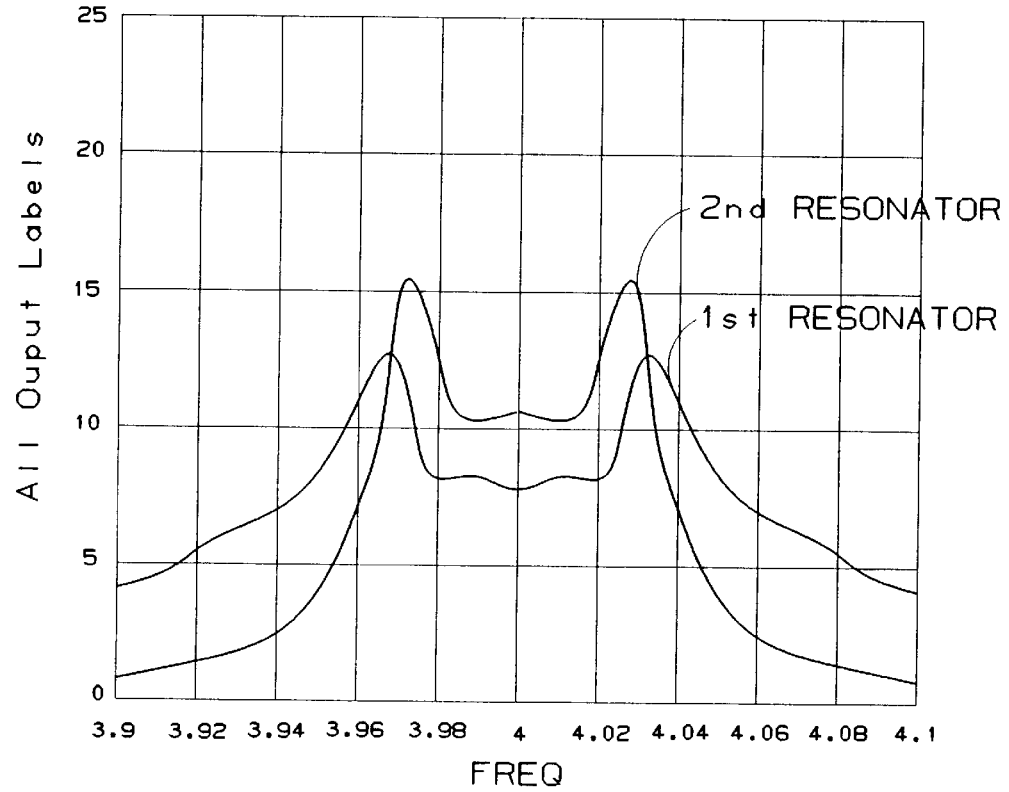
FIG. 11A is a graph showing the current distribution on a first and second resonator element of the filter of FIG. 10.
FIG. 11B is a graph showing the current distribution on a third and fourth resonator of the filter shown in FIG. 10.
Figure 11:
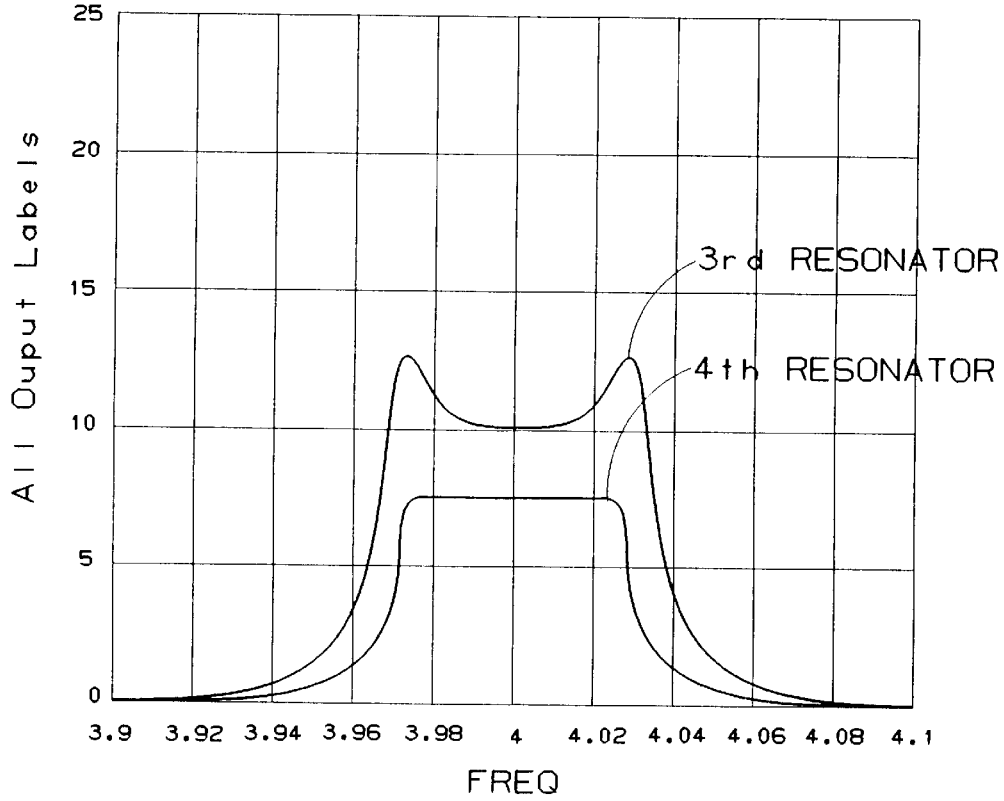

In FIG. 10, there is shown a top view of a circuit 70 of a four pole HTS hairpin filter 72 in which HTS film is deposited on a substrate 74. The filter 72 has four resonator elements 76, 78, 80, 82 with input line 84 and output line 86 deposited on a substrate 88. A typical current distribution for the resonator elements of the filter 72, as shown in FIGS. 11A and 11B, is not uniform. In FIG. 11A, the current distribution for the first and second resonators 76 and 78 is, respectively, shown. In FIG. 11B, the current distribution for the third and fourth resonators 80 and 82, respectively, is shown. It can be seen that the current flowing on the second resonator 78 is higher than the current flowing on any of the remaining resonators 76, 80, 82.

Figure 12:
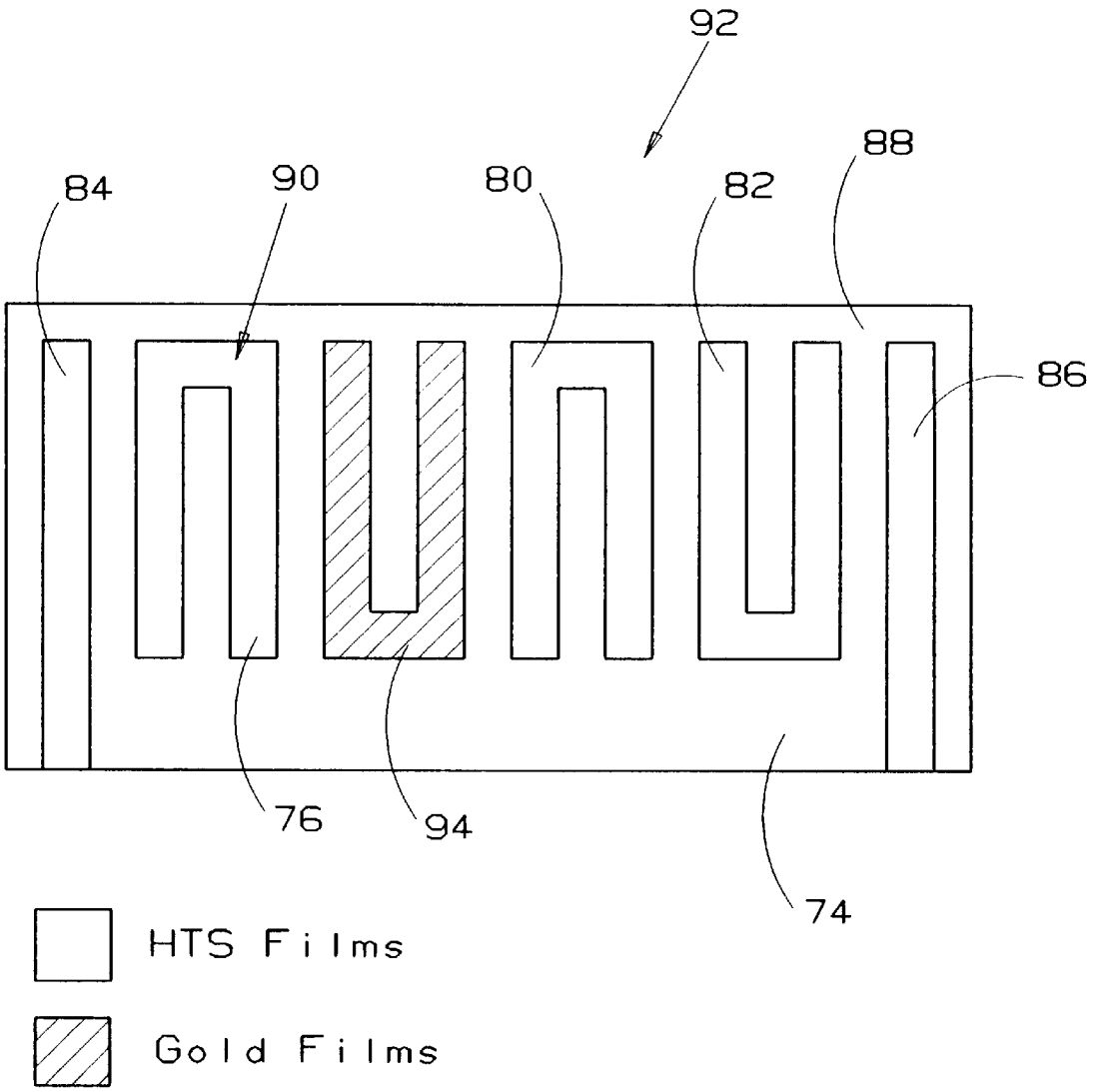
FIG. 12 is a top view of a circuit for a high power interdigital filter where one of the resonators is made from a gold film.

In FIG. 12, there is shown a circuit 90 of a filter 92 which differs from the filter 72 because a second resonator 94 is a gold film resonator used in place of the second resonator 78 of the filter 72. The resonator 94 of the filter 92 could consist of a thin gold film deposited on top of the HTS film which is deposited directly onto the substrate 74. The four resonator elements 76, 94, 80, 82 have an input line 84 and an output line 86 deposited on a substrate 88. As a further variation, thin gold films could be used to be deposited directly onto the substrate or to be deposited onto the HTS film, which is deposited directly onto the substrate. As a further alternative, the filter 92 could be manufactured by depositing a plurality of dielectric films on the HTS films with the objective of redistributing the current over the filter and reducing the current density. Dielectric films will also impact the RF performance of the filter. Therefore, the impact of these films on performance must be taken into account during the design process.

Figure 13:
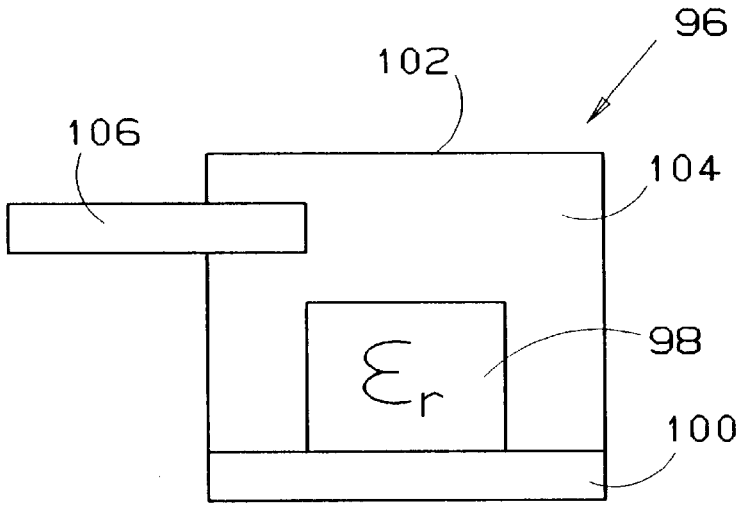
FIGURE 13 PRIOR ART
FIG. 13 is a top view of a prior art hybrid dielectric/high temperature superconductive resonator.
Figure 14:
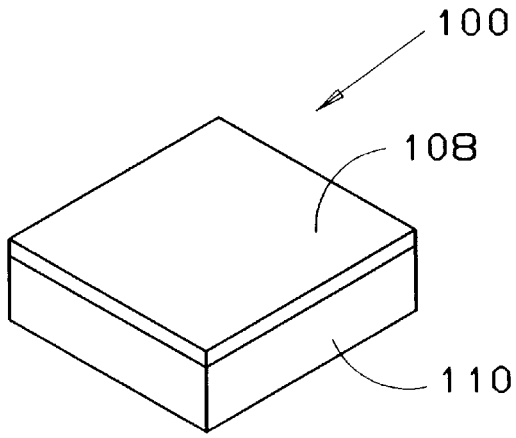
FIGURE 14 PRIOR ART
FIG. 14 is a perspective view of an enlarged prior art image-plate used in the resonator shown in FIG. 13.

In FIG. 13, there is shown a prior art hybrid dielectric/HTS resonator 96 having a dielectric resonator 98 mounted on an image plate 100 within a housing 102. RF energy is fed into a cavity 104 within the housing 102 through input probe 106. An enlarged perspective view of the prior art image plate 100 is shown in FIG. 14. It can be seen that the image plate has an HTS film 108 printed on a substrate 110, which can be made out of any dielectric material. The power handling capability of the resonator 96 can be increased by depositing gold film at certain locations on the resonator where the current density is high.

Figure 15:
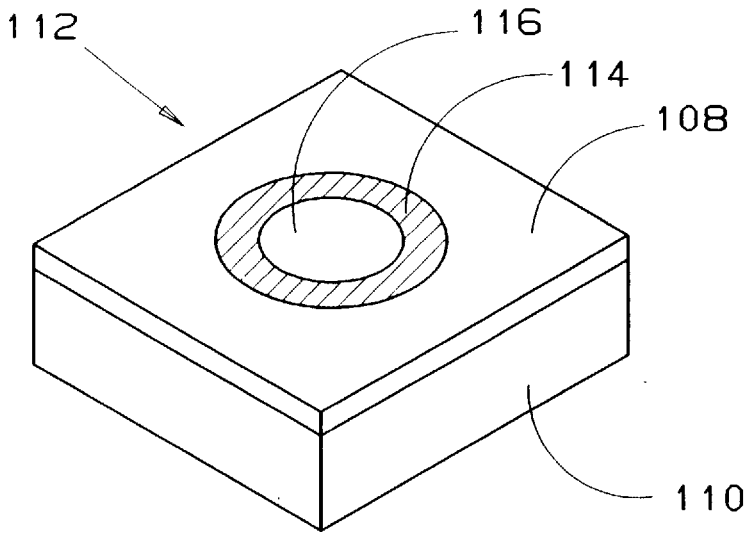
FIG. 15 is a perspective view of an annular resonator in accordance with the present invention.

In FIG. 15, there is shown a perspective view of a resonator 112 which is a variation of the resonator 100 of FIG. 13. The same reference numerals are used in FIG. 15 for those components that are the same as those of the resonator 100 shown in FIG. 14. The resonator 112 has an annular-shaped thin gold film deposited onto a central area 116 of the HTS film 108. The HTS film 108 is deposited on the substrate 110. Alternatively, the thin gold film 114 can be deposited directly onto the substrate 110 or partially on the HTS film and partially directly onto the substrate or, still further, the HTS film can be located adjacent to said part where both are deposited directly onto the substrate. Still further, the thin gold film can be located partially on the high temperature superconductive film and partially on the substrate or the superconductive film and the thin gold film can be located adjacent to one another where there is no overlap between them. The thin gold film referred to constitutes a means to reduce current density.

Figure 16:
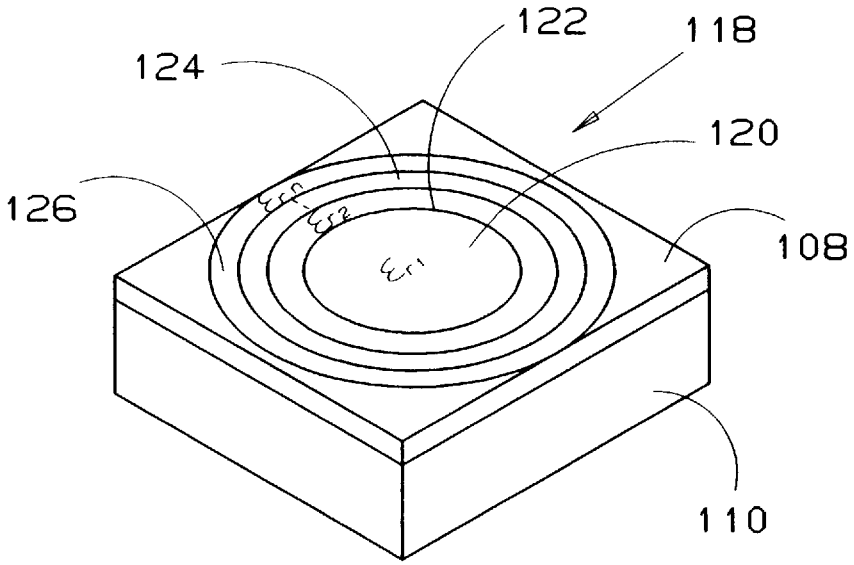
FIG. 16 is a further embodiment of an circular resonator having circles of different dielectric constants.

In FIG. 16, in a further variation of the resonator 100, there is shown a perspective view of a resonator 118 in which a plurality of roundly shaped dielectric films 120, 122, 124, 126 of different dielectric constants $E_{r1}$, $E_{r2}$, . . . $E_{rn}$ are deposited on top of the HTS film 108. The HTS film 108 is in turn deposited on the substrate 110. The shape of the dielectric films and the values of the dielectric constants depend on the type of resonating mode.

Figure 17:
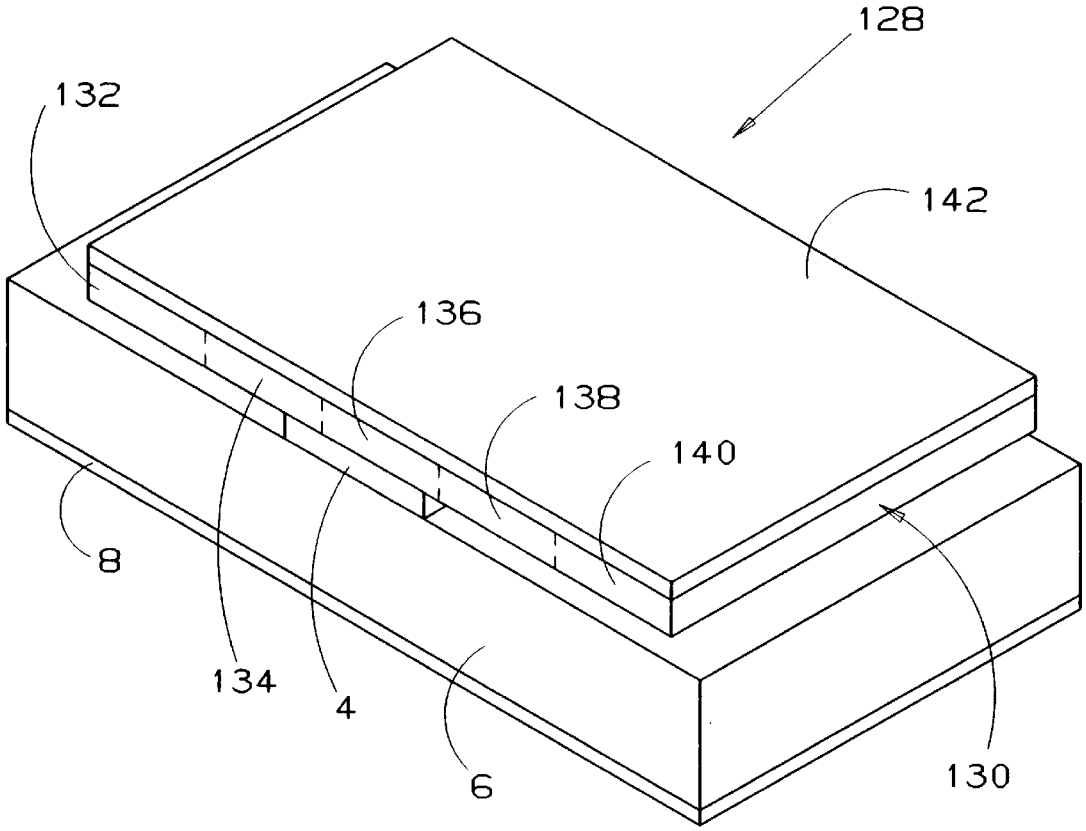
FIG. 17 is a perspective view of a further embodiment of a high power high temperature superconductive microstrip line.

In FIG. 17, there is shown a perspective view of a microstrip line 128 which is a still further variation of the prior art microstrip line 2 shown in FIG. 1. The same reference numerals are used as those used in FIG. 1 for those components that are the same. A dielectric constant gradient substrate 130 is mounted on top of the HTS film 4. The substrate 130 has a plurality of dielectric constant materials 132, 134, 136, 138, 140 having different dielectric constants $E_{r1}$, $Er_{r2}$, $E_{r3}$, $E_{r4}$ . . . $E_{rn}$ respectively. Overlying the dielectric constant materials 132, 134, 136, 138, 140 is an optional ground plane 142. The dielectric constant gradient substrate 130 redistributes the current density over the HTS film 4.

Figure 18:
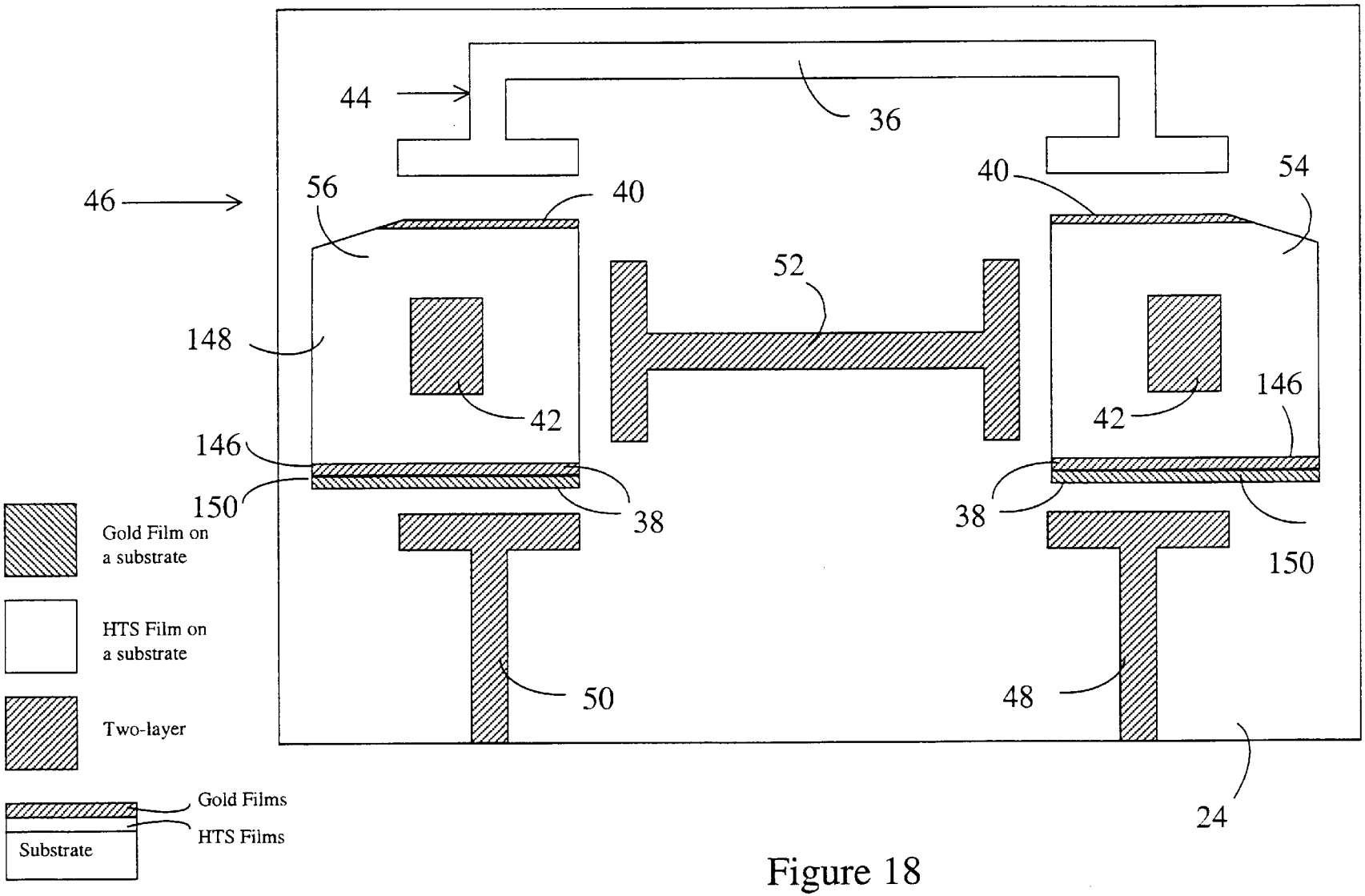
FIG. 18 is a top schematic view of a high power high temperature superconductive filter where part of a circuit of the filter is made from gold film deposited partially on a substrate and partially on a high temperature superconductive film.

FIG. 18 shows the filter of FIG. 8. The same reference numerals are used for FIG. 18 for those components that are identical to those of FIG. 8. Part 146 of the gold film 38 is deposited on HTS film 148 and part 150 of the gold film 38 is deposited directly on the substrate.

Figure 19:
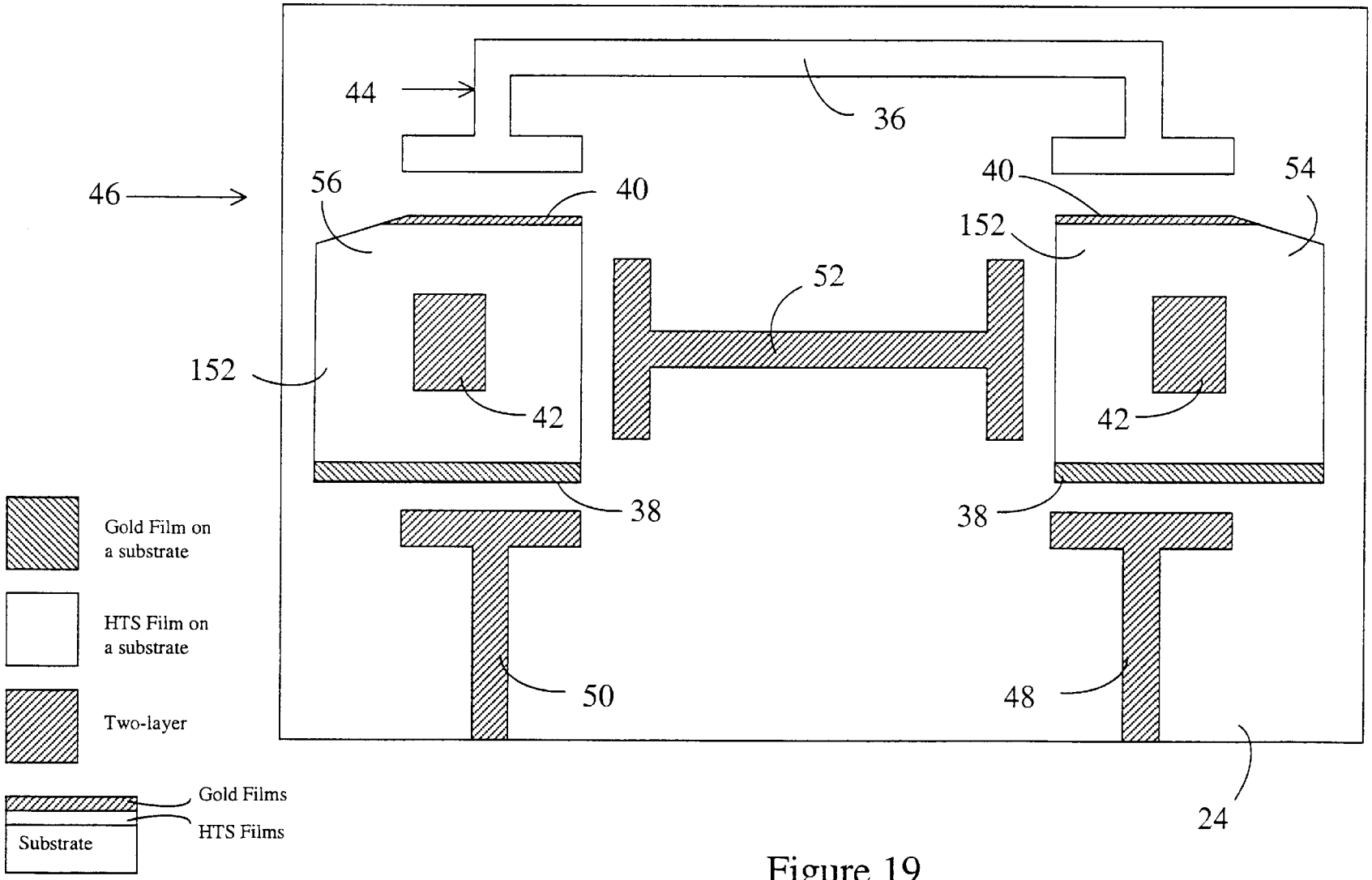
FIG. 19 is a top schematic view of a high power high temperature superconductive filter where part of a circuit of the filter is made from gold film deposited on a substrate and located adjacent to high temperature superconductive film deposited on the substrate.

In FIG. 19, the same reference numerals are used for those components that are identical to those of FIG. 8. From the legend, it can be seen that the gold film is deposited directly on the substrate and, for the resonators 54, 56, the gold film is located adjacent to high temperature superconductive film 152. There is no overlap between the part of the resonators that contains the gold film and the portion that contains the HTS film.

It should be noted that various changes and modifications can be made to the present invention within the scope of the attached claims. The means to reduce current density can be located partially on the high temperature superconductive film and partially on the substrate. Alternatively, the means to reduce current density and the HTS film can be located adjacent to one another where there is no overlap between the means to reduce current density and the HTS film. For example, the present invention can be used with planar structures other than microstrip structures such as coplanar lines, strip lines and suspended microstrip lines. Further, more or fewer areas of the circuits of prior art devices could be replaced or modified by highly conductive metal films, dielectric films or dielectric constant gradient substrates. The purpose of the replacements or modifications is to reduce the current density beyond that of a prior art device consisting only of HTS films at the same power level.

What I claim as my invention is:

1. A high temperature superconductive circuit for use with microwave devices, said circuit having high power handling capability and comprising:

(a) a substrate and a high temperature superconductive film on said substrate;

(b) means to reduce current density in certain portions of said high temperature superconductive film on top of part of said superconductive film, said means to reduce current density extending over part of said circuit leaving at least a substantial portion of said superconductive film exposed;

(c) said circuit having an input and output;

(d) said superconductive film and said means to reduce current density being configured to be in direct contact so that current can flow through said circuit between said input and said output when a signal is applied to said input.

2. A high temperature superconductive circuit for use with microwave devices, said circuit having high power handling capability and comprising:

(a) high temperature superconductive film on a substrate;

(b) part of said circuit having means to reduce current density in certain portions of said high temperature superconductive film below a current density that would otherwise exist in operation of said device when said part is comprised of said high temperature superconductive film without said means to reduce current density, said part and said high temperature superconductive film at least partially overlapping;

(c) said circuit having an input and output;

(d) said part and said high temperature superconductive film being configured to be in direct contact so that current can flow through said circuit between said input and said output when a signal is applied to said input.

3. A circuit as claimed in any one of claims 1 or 2 wherein said means to reduce current density is located partially on said high temperature superconductive film and partially on said substrate.

4. A circuit as claimed in any one of claims 1 or 2 wherein the means to reduce current density of said circuit is selected from the group consisting of a thin film of metal disposed on said high temperature superconductive film, a highly conductive metal film disposed on said high temperature superconductive film, a coupling element comprised of a thin film of metal disposed on said high temperature superconductive film and a resonator comprised of a thin film of metal disposed on said high temperature superconductive film.

5. A circuit as claimed in any one of claims 1 or 2 wherein said circuit has a patch resonator connected therein and said means to reduce current density in certain portions of said high temperature superconductive film is a thin film of metal disposed on specific areas of said high temperature superconductive film so that current can flow through said film of metal and said specific areas simultaneously when said high temperature superconductive film in said specific areas is superconductive and current can flow through said film of metal and not through said specific areas when said high temperature superconductive film in said specific areas is non-superconductive.

6. A circuit as claimed in any one of claims 1 or 2 wherein the means to reduce current density in certain portions of said high temperature superconductive film is a thin film of material selected from the group consisting of gold, silver and copper disposed on specific areas of said high temperature superconductive film.

7. A circuit as claimed in any one of claims 1 or 2 wherein the circuit has a patch resonator connected therein, said resonator also having means to reduce current density in certain portions of said high temperature superconductive film therein, said means to reduce current density being a thin film of material selected from the group consisting of gold, silver and copper.

8. A circuit as claimed in any one of claims 1 or 2 wherein the means to reduce current density in certain portions of said high temperature superconductive film is a plurality of dielectric films of different dielectric constants deposited on top of at least part of said high temperature superconductive film.

9. A circuit as claimed in claim 2 wherein the means to reduce current density is a dielectric constant gradient substrate deposited on top of at least a portion of the high temperature superconductive film.

10. A circuit as claimed in claim 9 wherein there is a ground plane mounted on top of the dielectric constant gradient substrate.

11. A circuit as claimed in any one of claims 9 or 10 wherein the circuit has a patch resonator connected therein and said means to reduce current density in certain portions of said high temperature superconductive film is located on said resonator.

12. A circuit as claimed in claim 2 wherein the means to reduce current density is a plurality of dielectric films of different dielectric constants deposited on top of said high temperature superconductive film.

13. A circuit as claimed in any one of claims 1, 2 or 12 wherein the high temperature superconductive film is comprised of ceramic material.

14. A circuit as claimed in claim 12 wherein said plurality of dielectric films is deposited over all of said high temperature superconductive film.

15. A method of enhancing the power capability of a high temperature superconductive circuit for use with microwave devices, said method comprising depositing a high temperature superconductive film on a substrate to form at least a portion of a microwave circuit, depositing a constant gradient substrate on top of at least some of said high temperature superconductive film to form means to reduce the current density in some of said superconductive film, said means to reduce the current density and said high temperature superconductive film being directly in contact so that current can flow through said circuit between an input and an output when a signal is applied to said input.

16. A method of enhancing the power capability of a high temperature superconductive circuit for use with microwave devices, said method comprising depositing a high temperature superconductive film on a substrate to form at least a portion of a microwave circuit, depositing means to reduce current density on specific areas of said high temperature superconductive film so that said means to reduce current density is in direct contact with said high temperature superconductive film to allow current to flow through said circuit between an input and an output when a signal is applied to said input, depositing said means to reduce current density in said specific areas of said circuit where the current density would otherwise be significantly higher than a remainder of said circuit where means to reduce current density has not been deposited.

17. A method of enhancing the power capability of a high temperature superconductive circuit for use with microwave devices, said method comprising depositing a high temperature superconductive film on a substrate to form at least a portion of a microwave circuit, depositing a thin film of metal on specific areas of said high temperature superconductive film to form means to reduce the current density, said means to reduce the current density being configured to be in direct contact with said high temperature superconductive film so that current can flow simultaneously through said portion and through said means to reduce current density between an input and an output when a signal is applied to said input and upon the condition that the critical current has not been exceeded in said specific areas, choosing the specific areas for depositing said thin film of metal where the current density would otherwise be significantly higher than a remainder of said circuit where said thin film of metal has not been deposited so that upon the condition that the critical current is exceeded in said specific areas, the current flows only through said means, said critical current being the current above which the high temperature superconductive film in said specific areas becomes non-superconductive.

18. A method of enhancing the power capability of a high temperature superconductive circuit for use with microwave devices, said method comprising depositing a high temperature superconductive film on a substrate to form at least a portion of a microwave circuit, depositing a plurality of dielectric films of different dielectric constants on top of at least some of said high temperature superconductive film to form means to reduce the current density in some of said high temperature superconductive film, said means to reduce the current density and said high temperature superconductive film being directly in contact so that current can flow through said circuit between an input and an output when a signal is applied to said input.

* * * * *